US005870011A

United States Patent [19]

Mori et al.

[11] Patent Number: 5,870,011

[45] Date of Patent: Feb. 9, 1999

[54] LINE FILTER

[75] Inventors: Tatsuya Mori, Katano; Hisayo Miyoshi, Hirakata; Shunya Inoue, Neyagawa; Hiroshi Tomita, Moriguchi, all of Japan

[73] Assignee: Matsushita Electric Industrial Co., Ltd., Osaka, Japan

[21] Appl. No.: 666,301

[22] PCT Filed: Nov. 2, 1995

[86] PCT No.: PCT/JP95/02246

§ 371 Date: Jun. 26, 1996

§ 102(e) Date: Jun. 26, 1996

[87] PCT Pub. No.: WO96/14643

PCT Pub. Date: May 17, 1996

[30] Foreign Application Priority Data

| | | | |
|---|---|---|---|
| Nov. 4, 1994 | [JP] | Japan | 6-271300 |
| Mar. 17, 1995 | [JP] | Japan | 7-058927 |
| Apr. 20, 1995 | [JP] | Japan | 7-094864 |
| Apr. 20, 1995 | [JP] | Japan | 7-094865 |

[51] Int. Cl.[6] ..... H01F 27/02; H01F 27/30; H01F 27/26

[52] U.S. Cl. ..... 336/90; 336/197; 336/196; 336/198

[58] Field of Search ..... 336/90, 92, 96, 336/198, 208, 210, 197

[56] References Cited

U.S. PATENT DOCUMENTS

| | | | |
|---|---|---|---|
| 4,760,366 | 7/1988 | Mitsui | 336/233 |
| 4,779,068 | 10/1988 | Sakamoto et al. | 336/198 |
| 5,005,097 | 4/1991 | Matsuoka | 336/121 |
| 5,227,745 | 7/1993 | Oda et al. | 336/210 |

FOREIGN PATENT DOCUMENTS

| | | | |
|---|---|---|---|
| 40 33 138 | 10/1990 | Germany | 336/92 |
| 61-205013 | 9/1986 | Japan . | |
| 63-175406 | 7/1988 | Japan | 366/208 |
| 2-127018 | 10/1990 | Japan . | |
| 3-25218 | 3/1991 | Japan . | |
| 4-94508 | 3/1992 | Japan | 336/192 |
| 4-63113 | 5/1992 | Japan . | |
| 4-99516 | 8/1992 | Japan . | |
| 5-198448 | 8/1993 | Japan | 336/90 |

*Primary Examiner*—Cassandra C. Spyrou
*Assistant Examiner*—Anh Mai
*Attorney, Agent, or Firm*—Ratner & Prestia

[57] ABSTRACT

The present invention relates to a line filter that is characterized by suppressing magnetic adverse effects inflicted on other components due to leakage magnetic fluxes from the closed magnetic circuit core used in the line filter and at the same time preventing noises from infiltrating into the closed magnetic circuit core. The line filter comprises a synthetic resin made bobbin (5) having flanges (2) on its both ends and a through hole (20) along its axis, a square shaped closed magnetic circuit core (1) with one of its magnetic legs inserted in the through hole (20) of the bobbin (5), windings (6) wound between both flanges (2) of the bobbin (5) in the direction perpendicular to the bobbin's axis, metal terminals (9) embedded in the flanges (2) and connected with the windings (6) and a wobbling preventive means to prevent the closed magnetic circuit core from wobbling.

24 Claims, 20 Drawing Sheets

LINE FILTER

FIELD OF TECHNOLOGY

The present invention relates to a line filter for use in a power supply circuit for various kinds of electronic equipment and the like.

BACKGROUND TECHNOLOGIES

As illustrated In FIG. 29 to FIG. 31, a prior art line filter has a structure wherein a winding bobbin 53 prepared by molding a resin material into two-piece construction is assembled on one of the magnetic legs of a square shaped closed magnetic circuit core 52 made of a high permeability magnetic material such as ferrite and the like and a pair of windings 54 are wound around the wire winding bobbin 53 by rotating the winding bobbin 53 by means of a gear formed on the end surface or on the central part of the winding bobbin 53.

Next, metal terminals 55 are placed in insertion holes arranged on flanges of the winding bobbin 53 and the windings' start and end lead wires are wrapped around and securely connected by soldering to the metal terminals 55. Further, a core cover 56 is installed so as to cover the core 52 and fixed on to the core 52 by having its opening's surfaces inserted in slots 57 formed on the outer surfaces of the flanges situated on both ends of the winding bobbin 53.

According to the prior art structure as described in the above, the square shaped closed magnetic circuit core 52 was not so securely fixed to the winding bobbin 53 and there was a danger that the core cover 56 might be detached because the fitting between the winding bobbin 53 and the core cover 56 was not good enough, resulting in an insufficient fixing between the square shaped closed magnetic circuit core 52 and the winding bobbin 53.

Particularly, there was a problem of magnetic flux leakage caused by the square shaped closed magnetic circuit core 52, inserted in the through hole of the winding bobbin 53, wobbling around the periphery of the winding bobbin 53 with the through hole serving as the center axis, thereby presenting magnetic disturbances to other components or allowing noises to infiltrate into the square shaped closed magnetic circuit core 52.

DISCLOSURE OF THE INVENTION

The object of the present invention is to provide a line filter, wherein magnetic adverse effects inflicted on other components due to leakage magnetic fluxes are suppressed by securely fixing a core cover to a closed magnetic circuit core to prevent the closed magnetic circuit core from wobbling.

In order to achieve the object as described in the above, the present invention discloses a structure comprising a bobbin having flanges on its both ends and a through hole formed along its axis, a closed magnetic circuit core inserted in the foregoing through hole, a winding wound between both flanges of the foregoing bobbin in the direction perpendicular to the bobbin's axis, terminals implanted in the foregoing flanges and connected with the foregoing winding, and a wobbling preventive means to prevent the foregoing closed magnetic circuit core from wobbling.

According to the structure described in the above, the core cover and closed magnetic circuit core are securely fixed with each other by the wobbling preventive means that prevents the closed magnetic circuit core from wobbling and the closed magnetic circuit core does not wobble around the periphery of the bobbin.

PREFERRED EMBODIMENTS OF THE INVENTION

EXAMPLE 1

Next, an explanation will be made on a line filter as a first exemplary embodiment of the present invention with the help of drawings.

Figure 1:
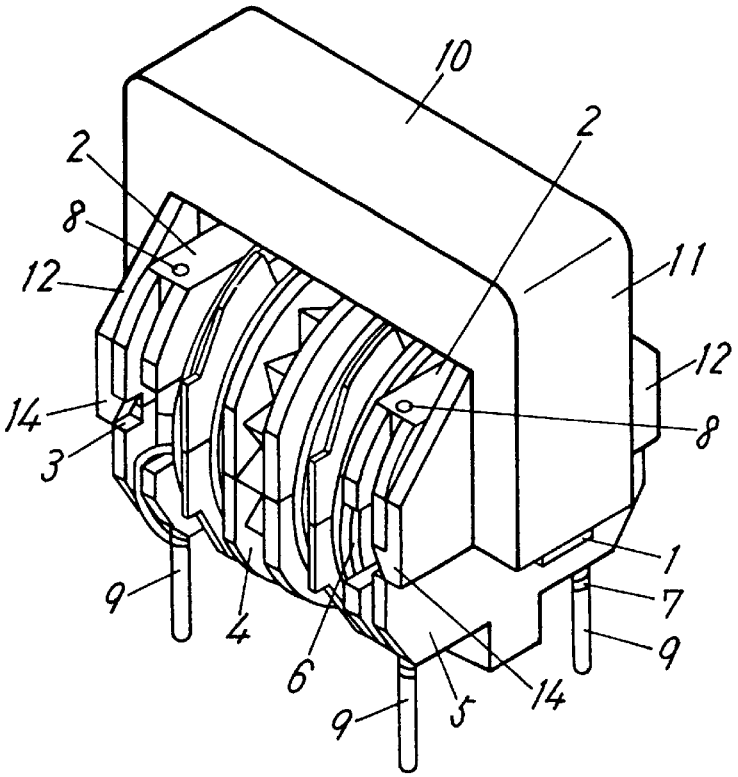
FIG. 1 is a perspective view of a line filter as a first exemplary embodiment of the present invention.
Figure 2:
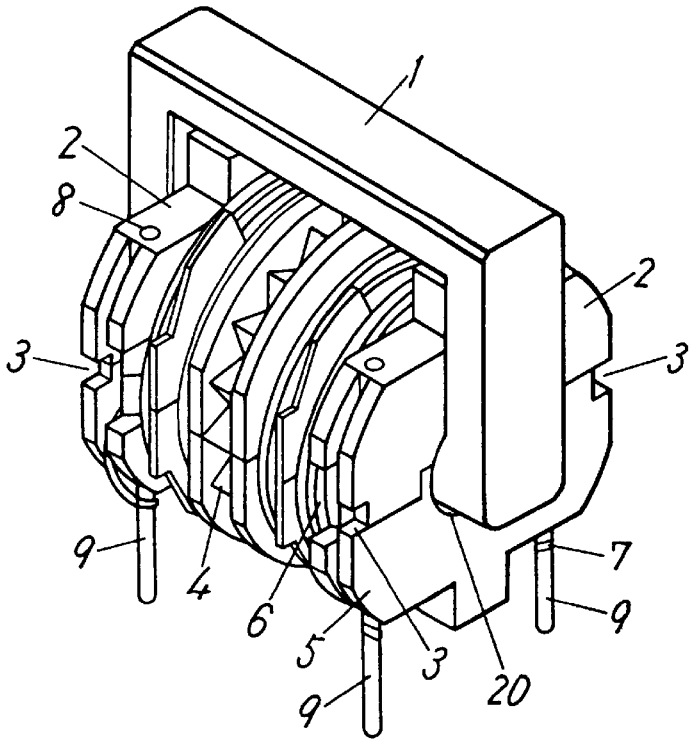
FIG. 2 is a perspective view of the line filter before installation of a wobbling preventive means.
Figure 3:
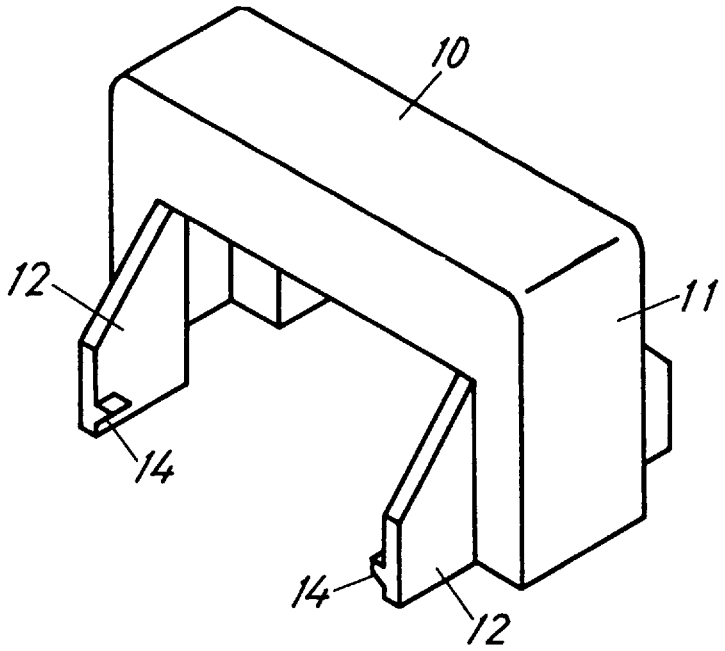
FIG. 3 is a perspective view of the foregoing wobbling preventive means for the line filter, FIG. 4(*a*) to FIG. 4(*d*) are a front view, side view, bottom view and cross-sectional view of the foregoing wobbling preventive means, respectively.
Figure 4A:
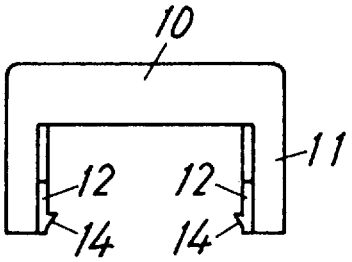
Figure 4B:
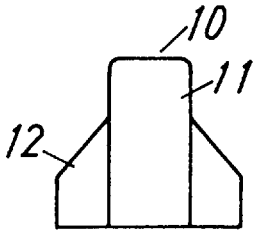
Figure 4C:
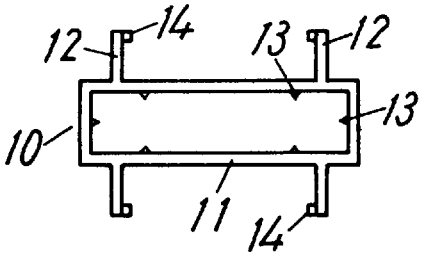
Figure 4D:
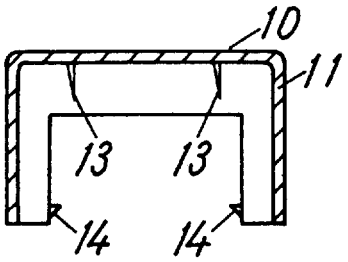
Figure 5:
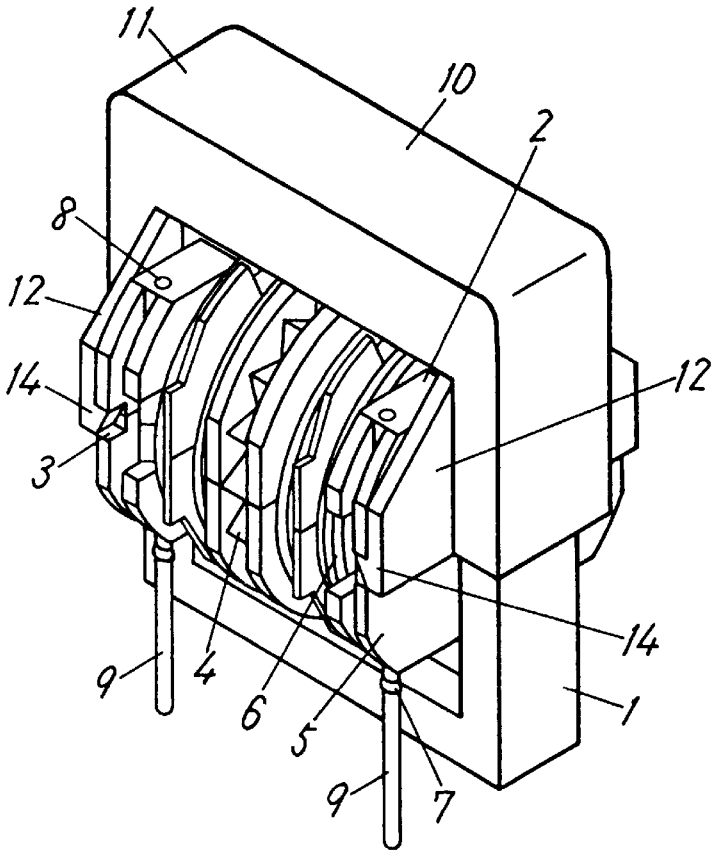
FIG. 5 is a perspective view of the foregoing line filter using a double E shaped core.

FIG. 1 is a perspective view of a line filter as a first exemplary embodiment of the present invention, FIG. 2 is a perspective view of the line filter before installation of a wobbling preventive means, FIG. 3 is a perspective view of the foregoing wobbling preventive means for the line filter, FIG. 4(*a*) to FIG. 4(*d*) are a front view, side view, bottom view and cross-sectional view of the foregoing wobbling preventive means, respectively, and FIG. 5 is a perspective view of the foregoing line filter using a double E shaped core.

The line filter of Example 1 comprises a bobbin 5 made of a synthetic resin and having flanges 2 on its both ends and a through hole 20 formed along its axis, a square shaped closed magnetic circuit core 1 inserted in the through hole 20 that is formed around the center axis of the bobbin 5, a winding 6 wound between both flanges 2 of the bobbin 5 in the direction perpendicular to the bobbin's axis, terminals 9 implanted in the flanges 2 and connected with the winding 6, and a wobbling preventive means to prevent the closed magnetic circuit core 1 from wobbling. In the above, the bobbin 5 is resin molded around one of the magnetic legs of the one-piece square shaped closed magnetic circuit core 1 composed of a high permeability magnetic material such as ferrite and the like, with slots 3 formed horizontally on the outside surface of each respective flange 2 at 2 to 4 places and with a gear 4 formed in its central part or on its end surface.

Further, by rotating the gear 4 of the foregoing bobbin 5 with an external force applied to it, the bobbin is rotated and a pair of the winding 6 are placed in two winding slots of the bobbin 5 by winding insulated copper wires in the same direction. The lead wires 7 at the start and the end of the winding 6 are wrapped around the terminals 9 that have been inserted securely in holes 8 formed on the flanges 2 at both ends of the bobbin 5 after the above winding process, and then connected by soldering or the like.

Instead, the terminals 9 are inserted in the bobbin 5 in advance before winding and then the terminals 9 are moved over a necessary distance after winding and the lead wires 7 at the start and the end of the winding 6 may be connected to the terminals 9.

Next, a core cover 10 that puts together securely the foregoing single-piece square shaped closed magnetic circuit core 1, bobbin 5 and winding 6 will be explained with the help of FIG. 3 and FIG. 4(*a*) to FIG. 4(*d*).

The core cover 10 is made of a synthetic resin and comprises a flat U shaped core fixing member 11 that covers the single-piece square shaped closed magnetic circuit core 1 sticking out of the foregoing bobbin 5 and bobbin holding members 12 that are formed on both ends of the core fixing member 11 and come in contact with the outside surface of each respective flange 2 on both ends of the bobbin 5.

In addition, a plurality of ribs are formed on the inside surfaces of the core fixing member 11 to hold securely the square shaped closed magnetic circuit core 1 even when the latter exhibits some dimensional variations, and a projection 14 is formed on each respective inside edge located at the lower ends of the bobbin holding member 12 to get engaged in the slot 3 formed on each respective flange 2 located at both ends of the bobbin 5.

The core cover 10 is securely fixed by first having the foregoing square shaped closed magnetic circuit core 1 placed in the core cover 10, and then having the projections 14 of the core cover 10 engaged in the slots 3 on the flanges 2 of both ends of the bobbin 5 and further having the bobbin 5 sandwiched between the bobbin holding members 12 of the core cover 10.

According to the structures as described in the above, the closed magnetic circuit core and the winding bobbin are held together securely by the core cover, and the dangers of loose engagement and disengagement of the core cover are eliminated. Moreover, it is possible to protect the closed magnetic circuit core against physical shock.

A square shaped core was used as the closed magnetic circuit core 1 in the above example. However, as shown in FIG. 5, a single-piece double E shaped core can also be used as the closed magnetic circuit core 1 with the remaining structures kept the same as the above example.

EXAMPLE 2

Next, an explanation will be made on a line filter as a second exemplary embodiment of the present invention with the help of drawings.

Figure 6:
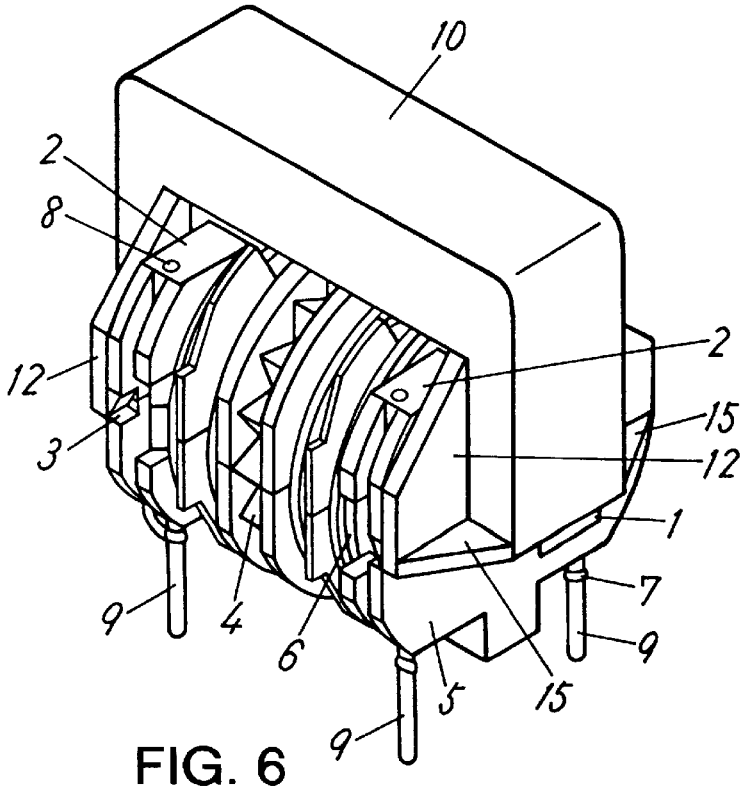
FIG. 6 is a perspective view of a line filter as a second exemplary embodiment of the present invention and FIG. 7 is a perspective view of a wobbling preventive means for the foregoing line filter.
Figure 7:
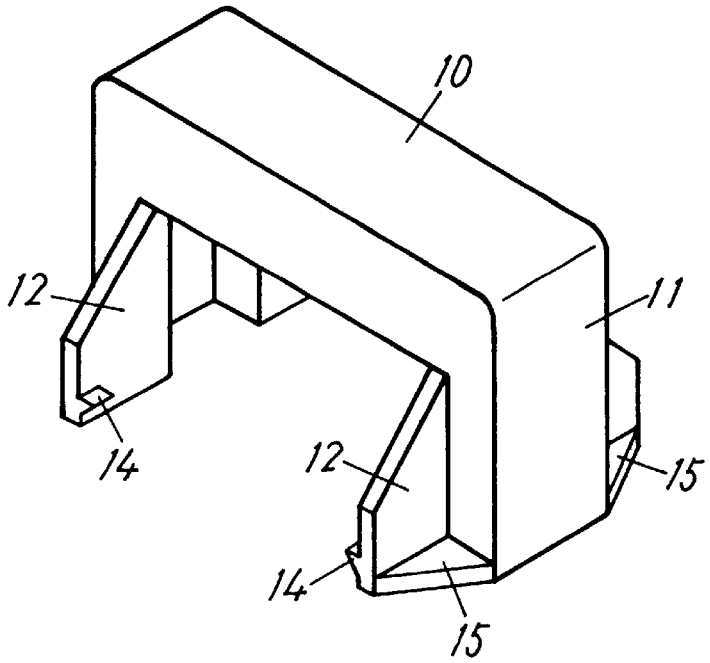

FIG. 6 is a perspective view of a line filter as a second exemplary embodiment of the present invention and FIG. 7 is a perspective view of a wobbling preventive means for the foregoing line filter.

In Example 2, a core cover 10 comprises a flat U shaped core fixing member 11 that is engaged with a closed magnetic circuit core 1, bobbin holding members 12 that have a plurality of projections 14 and extend along the outside surfaces of the flanges 2 formed on both ends of a bobbin 5, and strengthening ribs 15 that are formed between the core fixing members 11 and the bobbin holding members 12.

The core cover 10 is securely fixed by first having the closed magnetic circuit core 1 placed in the core cover 10, and then having the projections 14 of the core cover 10 engaged in the slots 3 formed on the flanges 2 at both ends of the bobbin 5.

By having the strengthening ribs 15 in place, the strength of the core cover 10 has been increased and when the core cover 10 is put together with the closed magnetic circuit core 1 and the bobbin 5, the solidity of the whole assembly has been further enhanced.

EXAMPLE 3

Next, an explanation will be made on a line filter as a third exemplary embodiment of the present invention with the help of drawings.

Figure 8:
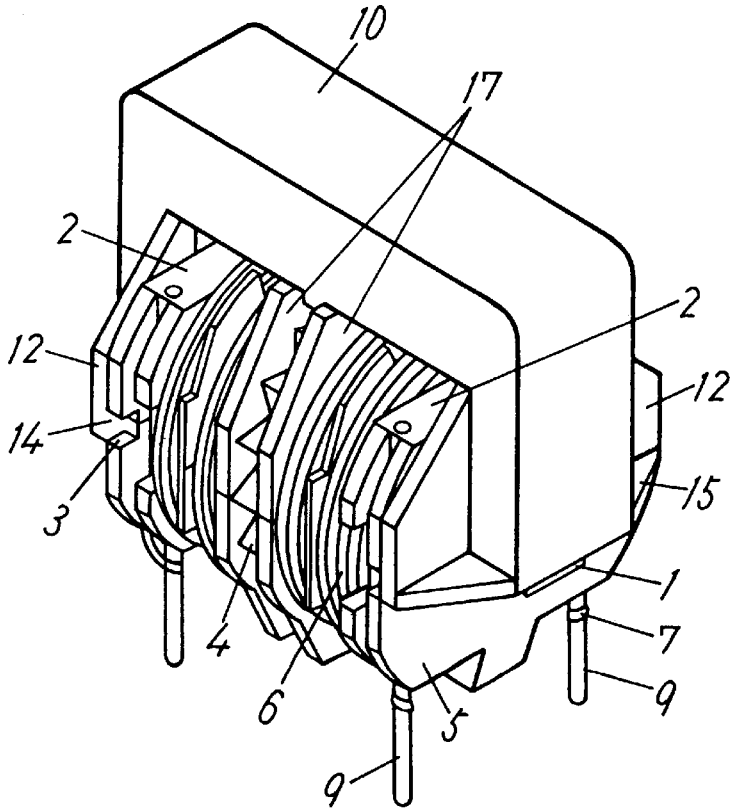
FIG. 8 is a perspective view of a line filter as a third exemplary embodiment of the present invention.
Figure 9:
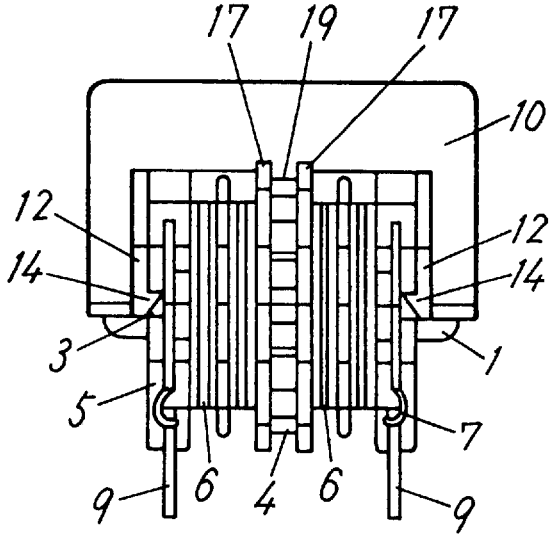
FIG. 9 is a front view of the foregoing line filter.
Figure 10:
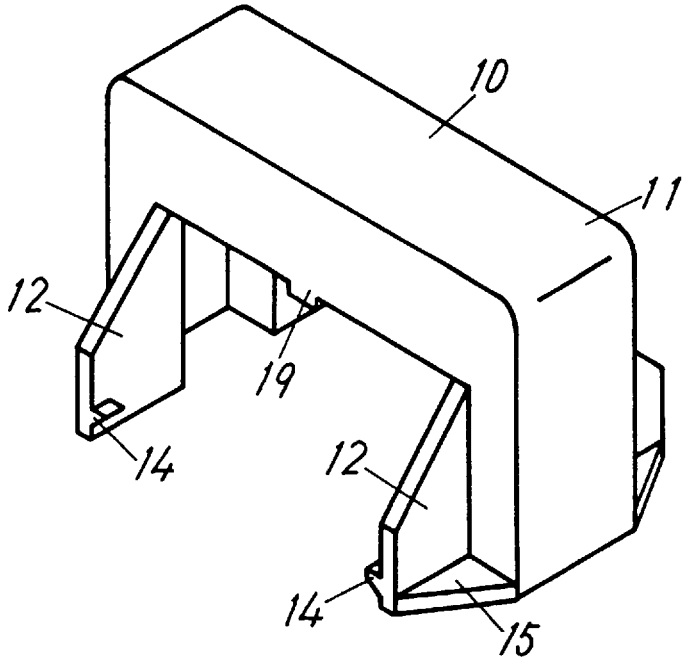
FIG. 10 is a perspective view of a wobbling preventive means for the foregoing line filter.
Figure 11:
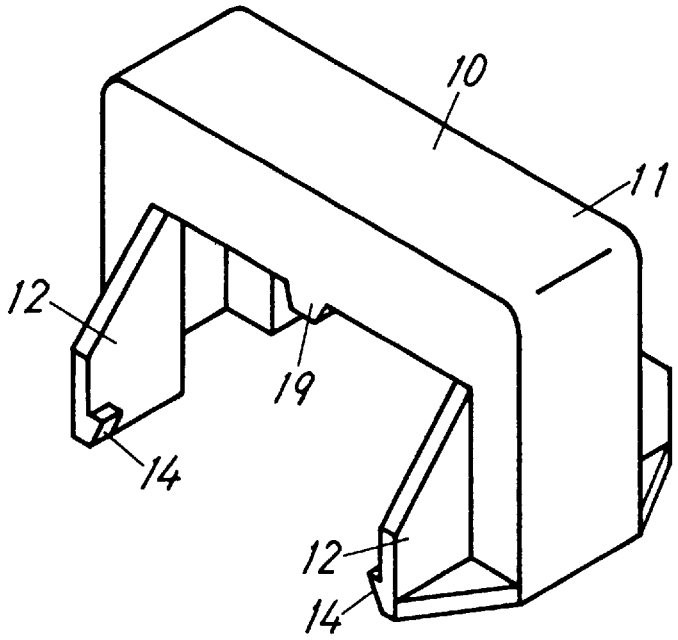
FIG. 11 is a perspective view of the foregoing wobbling preventive means for the line filter and FIG. 12 is a perspective view of the foregoing line filter before installation of the foregoing wobbling preventive means.
Figure 12:
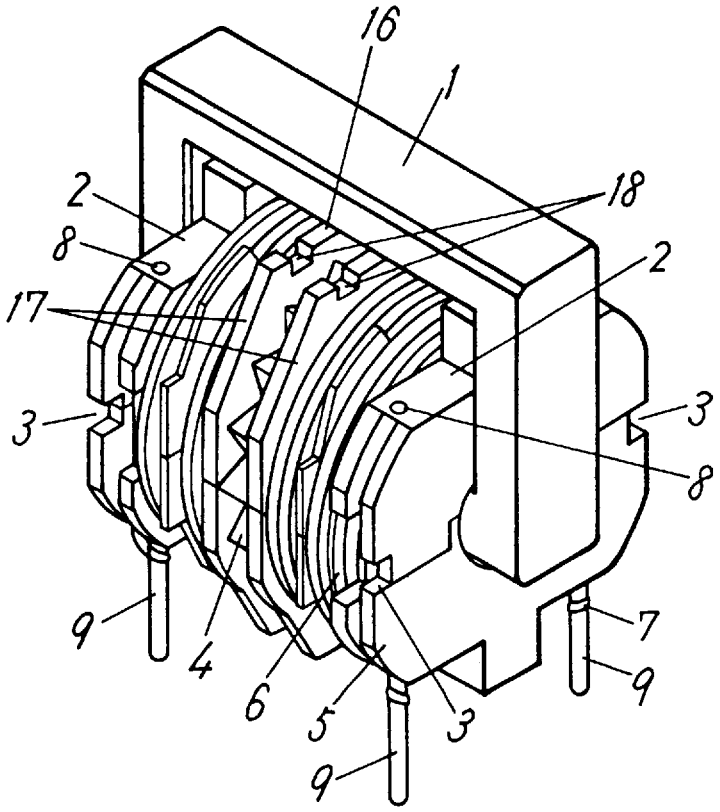

FIG. 8 is a perspective view of a line filter as a third exemplary embodiment of the present invention, FIG. 9 is a front view of the foregoing line filter, FIG. 10 is a perspective view of a wobbling preventive means for the foregoing line filter, FIG. 11 is a perspective view of the foregoing wobbling preventive means for the line filter and FIG. 12 is a perspective view of the line filter before installation of the wobbling preventive means.

In Example 3, a bobbin 5 has in its center a split flange 17 with flat portions 16 that are of the same height as the flanges 2 on both ends of the bobbin 5 and each of the flat portions 16 has a slot 18. A core fixing member 11 of a core cover 10 has a projection 19 in the center at its lower part.

Next, the core cover 10 is securely fixed in the winding's width direction by first having a closed magnetic circuit core 1 placed in the core cover 10, and then having the opening end of the core fixing member 11 of the core cover 10 engaged in the slot 18 formed on the flat portion 16 of each respective split flange 17 in the center of the bobbin 5 and further having the projection 19 of the core cover 10 engaged in the split flange 17 of the bobbin 5. As shown in FIG. 11, the width of the projection 19 of the core cover 10 may taper towards the tip.

Moreover, by having an elongated projection 19 engaged with gears 4 formed between the split flanges 17 in the center of the bobbin 5, fixing of the bobbin 5 in the rotational direction can be securely achieved.

EXAMPLE 4

Next, an explanation will be made on a line filter as a fourth exemplary embodiment of the present invention with the help of drawings.

Figure 13:
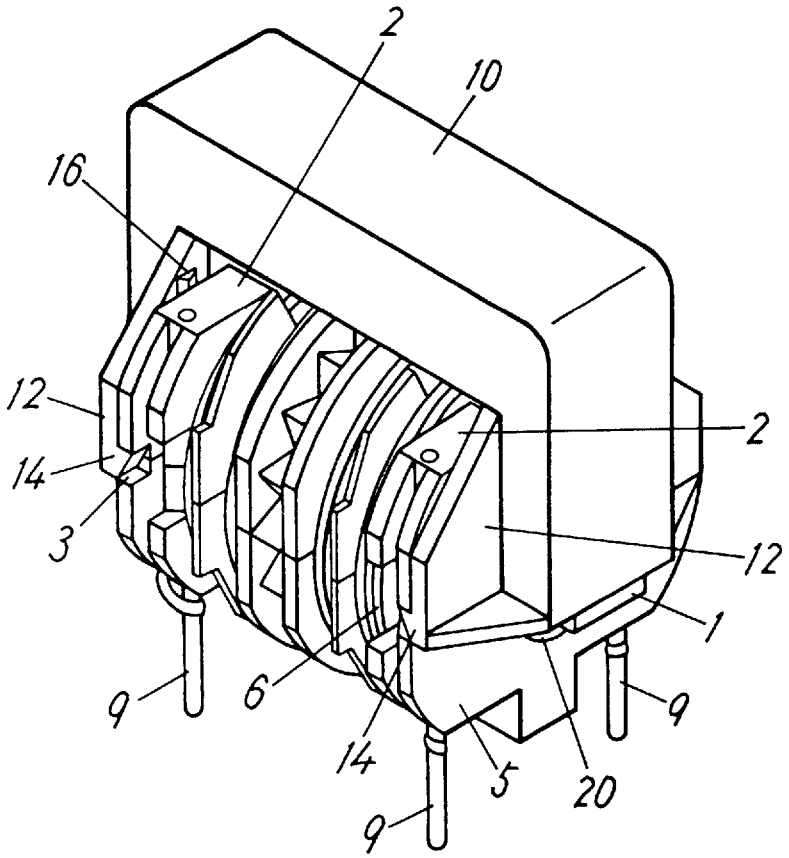
FIG. 13 is a perspective view of a line filter as a fourth exemplary embodiment of the present invention.
Figure 14:
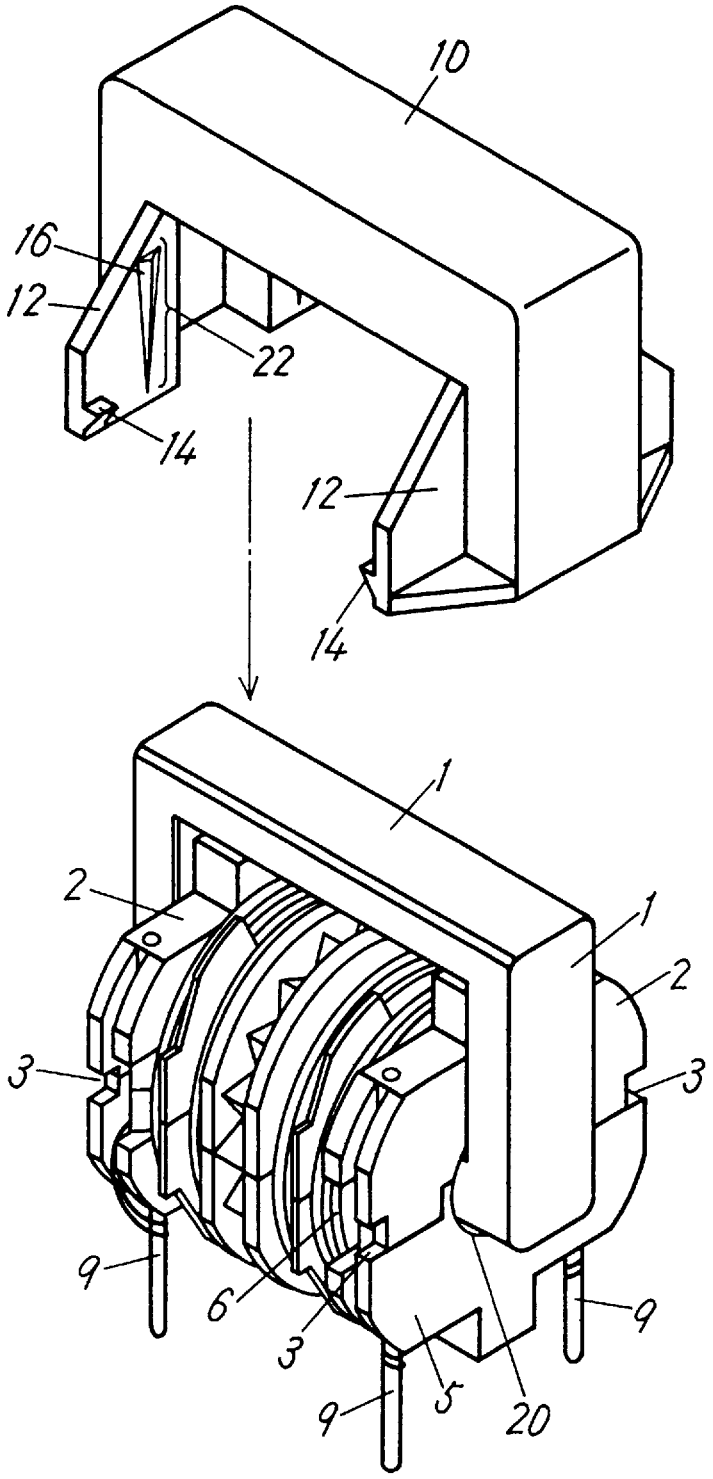
FIG. 14 is an exploded perspective view of the foregoing line filter.
Figure 15:
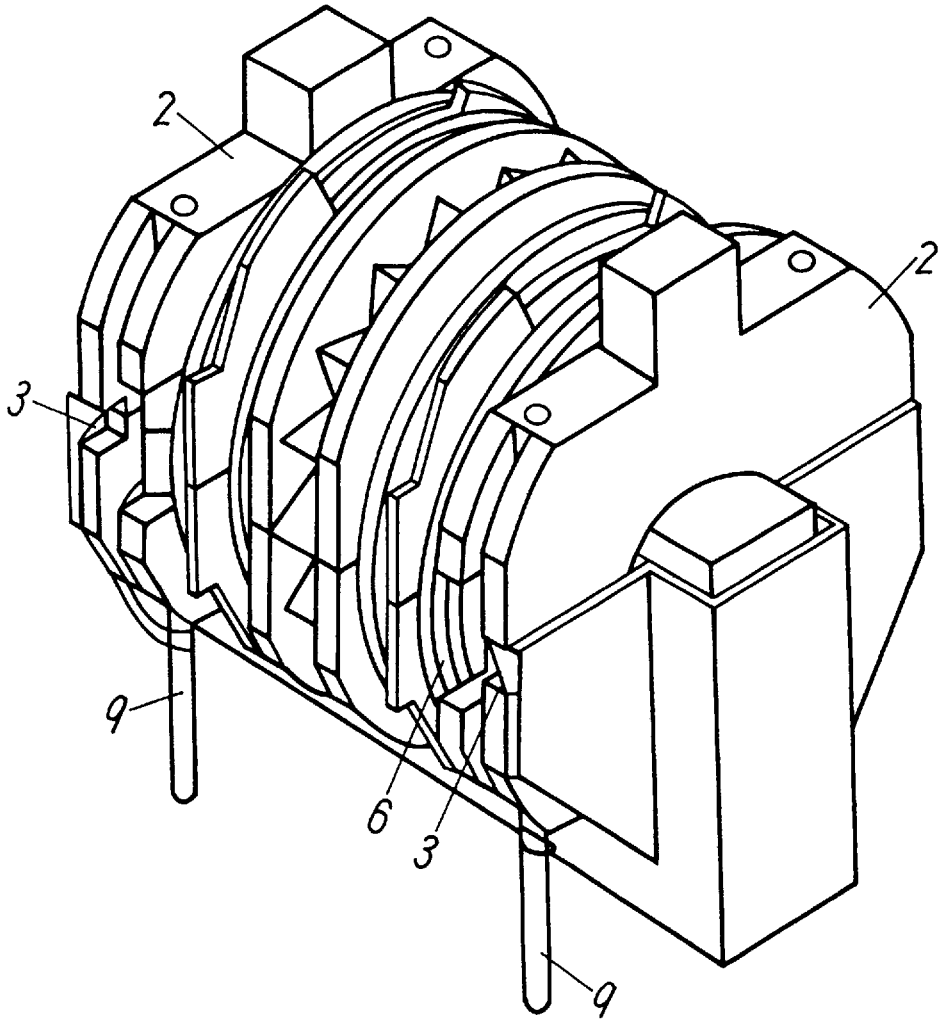
FIG. 15 is a perspective view of the other foregoing line filter installed with a wobbling preventive means and FIG. 16 is a perspective view of another foregoing line filter installed with a wobbling preventive means.
Figure 16:
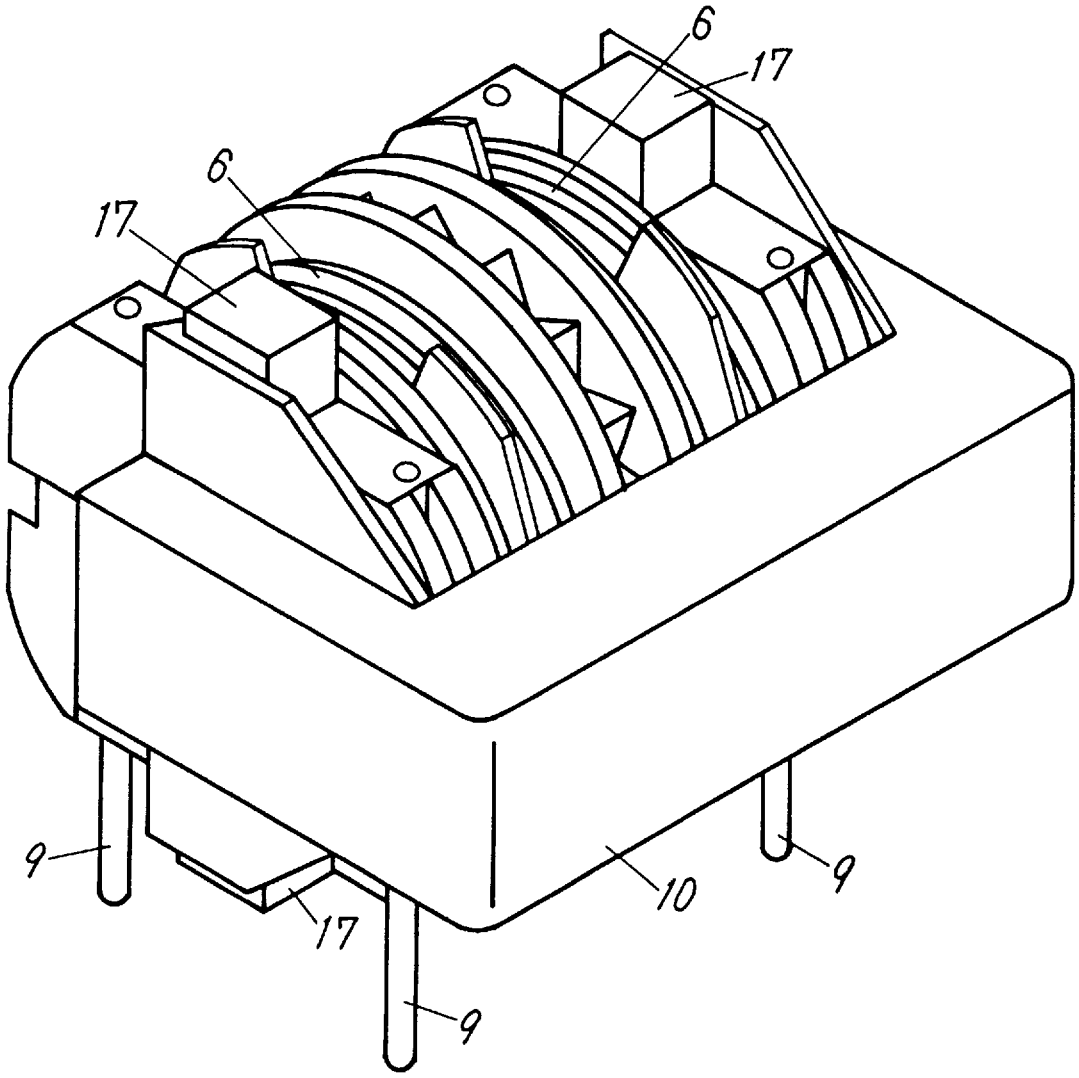

FIG. 13 is a perspective view of a line filter as a fourth exemplary embodiment of the present invention, FIG. 14 is an exploded perspective view of the foregoing line filter, FIG. 15 is a perspective view of the other foregoing line filter installed with a wobbling preventive means and FIG. 16 is a perspective view of another foregoing line filter installed with a wobbling preventive means.

In Example 4, a core cover 10 has bobbin holding members 12 for a bobbin 5, opposing to the side surfaces of flanges 2 of the bobbin 5, and each of the bobbin holding members 12 has a projection 14 that engages with the flange 2 of the bobbin 5 and also has a rib 21 on the side surface facing the flange 2 so as to be pressed against the flange 2, while a slot 3 being formed on the flange 2 so that it engages with the projection 14 of the bobbin holding member 12.

The core cover 10 is placed over the bobbin 5 from above, while holding a closed magnetic circuit core 1 above the bobbin 5 and keeping its position vertically, and fixed to the bobbin 5 for a precise positioning.

In the above arrangement, the projection 14 is protruded from the bobbin holding member 12 of the core cover 10 towards the side surface of the flange 2 of the bobbin 5 while the slot 3 being recessed for proper engagement with the projection 14.

Furthermore, the rib 21 is shaped like a triangular pyramid protruding from the bobbin holding member 12 of the core cover 10 towards the side surface of the flange 2 of the bobbin 5.

Next, an explanation will be made on how the foregoing structures of the line filter work.

One of the magnetic legs of the closed magnetic circuit core 1 is inserted in the through hole 20 of the bobbin 5 and another magnetic leg opposite to the above magnetic leg is covered by the core cover 10 while the projection 14 formed on the bobbin holding member 12 of the foregoing core cover 10 being held by the slot 3 formed on the flange 2 and also the rib 21 formed on the side surface facing the flange 2 being pressed against the flange 2, resulting in that the core cover 10 is held securely and precisely in position by the flanges 2 of the bobbin 5.

Thus, the closed magnetic circuit core 1 covered by the core cover 10 can be held on the upper surface of the bobbin 5 securely and precisely in position without any wobbling around the bobbin 5.

Since the projection 14 is protruded from the bobbin holding member 12 of the core cover 10 towards the side surface of the flange 2 of the bobbin 5 and also the slot 3 is recessed for proper engagement with the projection 14, the core cover 10 is fixed to the flange 2 of the bobbin 5 securely in both horizontal and vertical directions.

Moreover, since the rib 21 is shaped like a triangular pyramid protruding from the bobbin holding member 12 of the core cover 10 towards the side surface of the flange 2 of the bobbin 5, the core cover 10 can be readily installed on the the flanges 2 of the bobbin 5 and also the tapered portion 22 of the rib 21 makes it possible to adjust the intensity of pressing force between the bobbin holding member 12 of the core cover 10 and the flange 2 of the bobbin 5 for assured holding.

Although the closed magnetic circuit core 1 is arranged towards the above of the bobbin 5 in the present example and the core cover 10 is placed over the closed magnetic circuit core 1 to install on the bobbin 5 while the closed magnetic circuit core 1 being kept in the vertical direction for secure holding and precise positioning, the closed magnetic circuit core I can be arranged towards the bottom of the bobbin 5 as shown in FIG. 15 and the core cover 10 is placed over the closed magnetic circuit core 1 from below the bobbin 5 to achieve the same effect.

The slot 3 of the present example is recessed to engage with a projection, but it can be a hole or the like as far as it can engage with the projection 14.

Furthermore, although the rib 21 is shaped like a triangular pyramid in the present example, it can be conical in shape as far as it has a tapered portion.

In addition, by holding the position of the closed magnetic circuit core 1 securely and precisely in position in the horizontal direction with the help of a projection 23 formed on the upper part of the flange 2 and the projection 14 formed on the bobbin holding member 12 of the core cover 10, the magnetic adverse effects inflicted on the mounted components surrounding the line filter can be suppressed remarkably when the line filter is mounted on a circuit board and the like.

EXAMPLE 5

Next, an explanation will be made on a line filter as a fifth exemplary embodiment of the present invention with the help of drawings.

Figure 17:
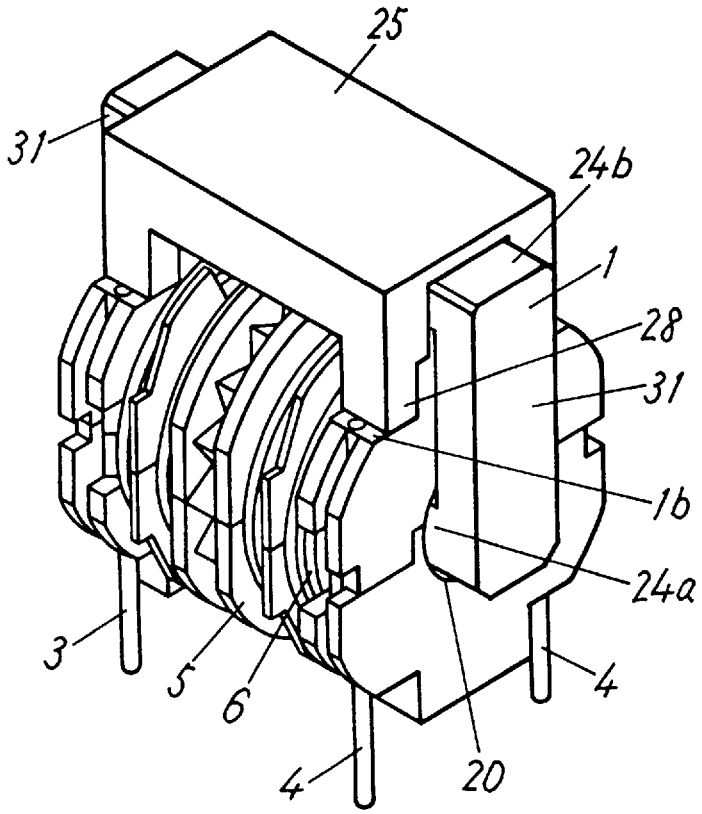
FIG. 17 is a perspective view of a line filter as a fifth exemplary embodiment of the present invention.
Figure 18:
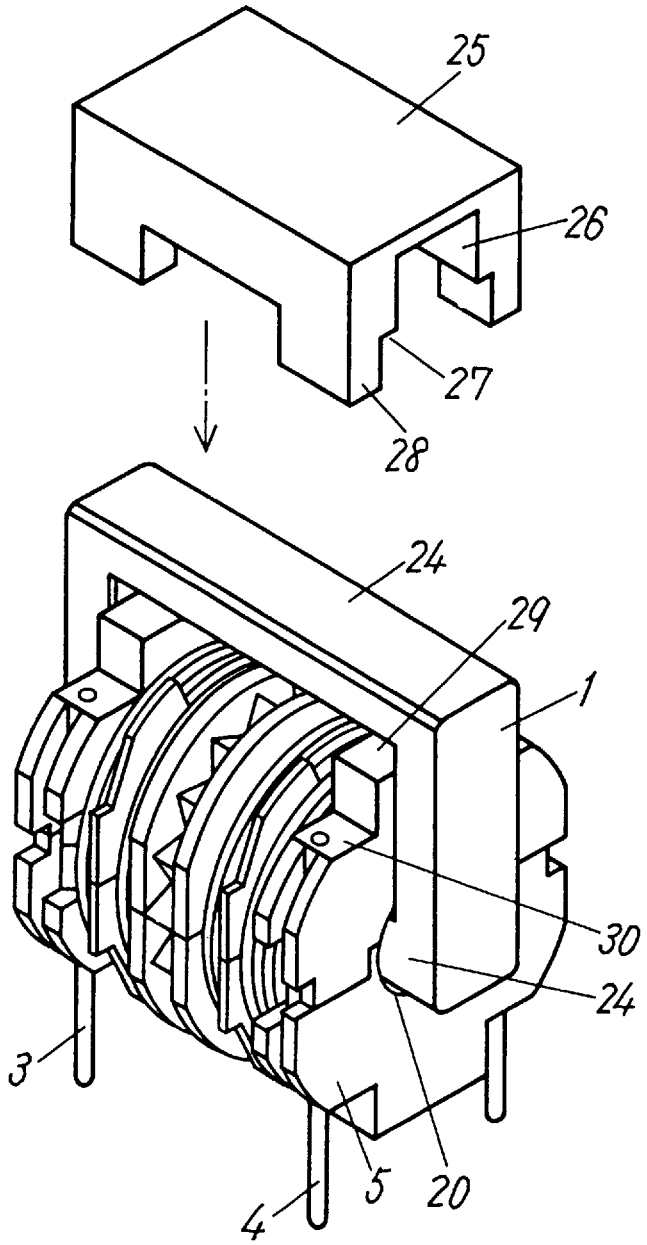
FIG. 18 is an exploded perspective view of the foregoing line filter.
Figure 19:
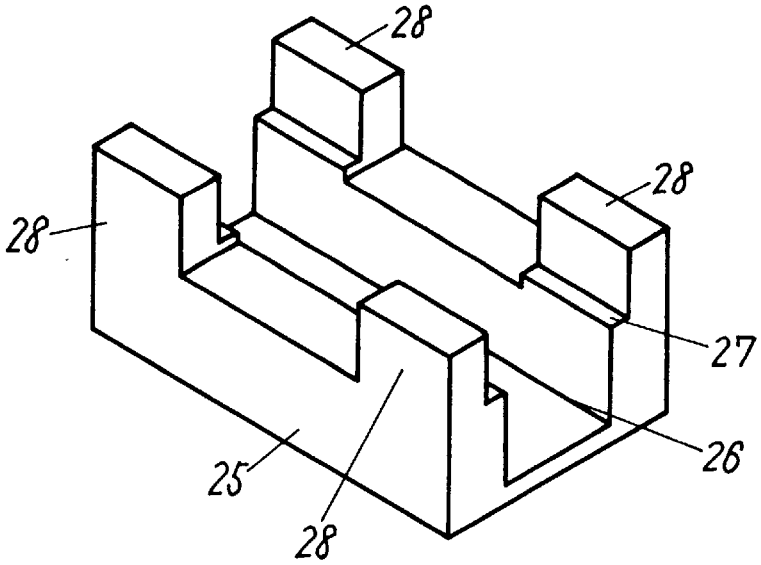
FIG. 19 is a perspective view of a wobbling preventive view for the foregoing line filter.
Figure 20:
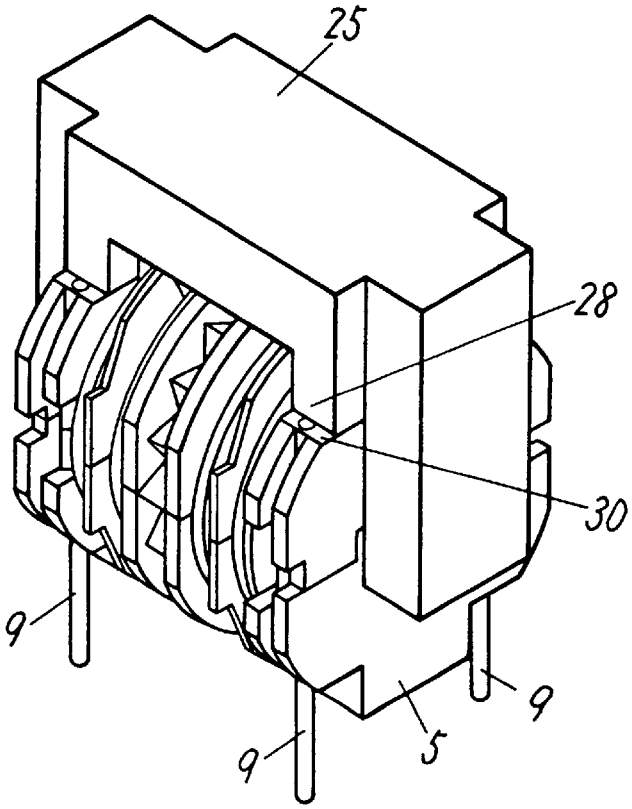
FIG. 20 is a perspective view of a line filter wherein a cover extension is incorporated with a fastening means.
Figure 21:
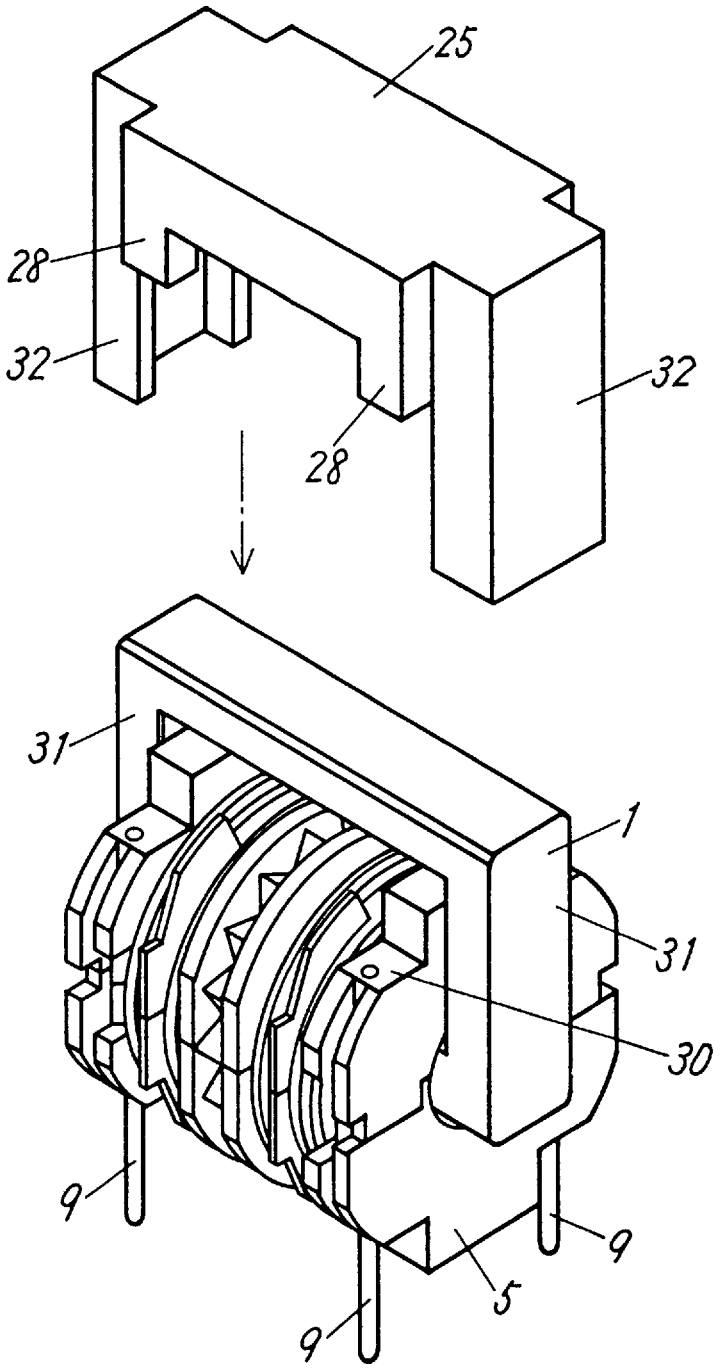
FIG. 21 is an exploded perspective view of the foregoing line filter and FIG. 22 is a perspective view of the wobbling preventive means for the foregoing line filter.
Figure 22:
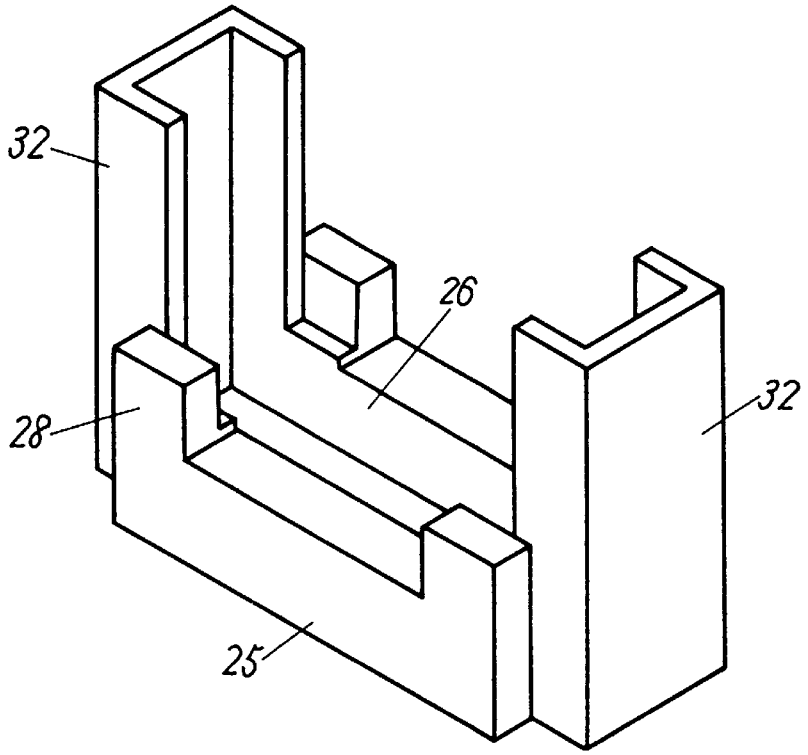

FIG. 17 is a perspective view of a line filter as a fifth exemplary embodiment of the present invention, FIG. 18 is an exploded perspective view of the foregoing line filter, FIG. 19 is a perspective view of a wobbling preventive means for the above line filter, FIG. 20 is a perspective view of a line filter having extended covering portions as fastening means, FIG. 21 is an exploded perspective view of the foregoing line filter and FIG. 22 is a perspective view of the wobbling preventive means for the foregoing line filter.

In Example 5, a closed magnetic circuit core 1 is in place with a magnetic leg 24*b* arranged towards above a bobbin 5 opposing to another magnetic leg 24*a* as shown in FIG. 18 and then a fastening means 25 made of a synthetic resin is installed so as to cover the opposing magnetic leg 24*b*.

As shown in FIG. 19, the fastening means 25 comprises a groove 26 formed on the inner surface of its top structure for containing the opposing magnetic leg 24*b*, stepped places 27 formed on each respective side surface of the groove 26 and 4 legs 28 located further out of the stepped places 27.

These stepped places 27 hit stepped places 29 formed on the upper part of the bobbin 5 and the legs 28 sit on adhesion pads 30 located further out of the stepped places 29. Since an adhesive has been applied on the adhesion pads 30 in advance, the legs 28 are fixed on the adhesion pads 30 by the adhesive.

It should be noted that deposition of the foregoing adhesive on the closed magnetic circuit core 1 causes a mechanical stress to be applied to the closed magnetic circuit core 1, resulting in changes of its magnetic characteristics. However, the present example has the adhesion pads 30, where the adhesive is supplied, located further out of the stepped places 29, and so there is no danger of the adhesive flowing towards the closed magnetic circuit core 1 and depositing on it, thus causing no changes in its magnetic characteristics.

Also it is preferable to have the adhesion pads 30 slanted downward towards outside of the closed magnetic circuit core 1 to prevent the adhesive from flowing out of the adhesion pads 30 towards the closed magnetic circuit core 1.

Furthermore, the same effect can be expected by having the extended covering portions 32 located at both ends of the fastening means 25 to cover both magnetic side legs 31 as shown in FIG. 20 to FIG. 22.

EXAMPLE 6

Next, an explanation will be made on a line filter as a sixth exemplary embodiment of the present invention with the help of drawings.

Figure 23:
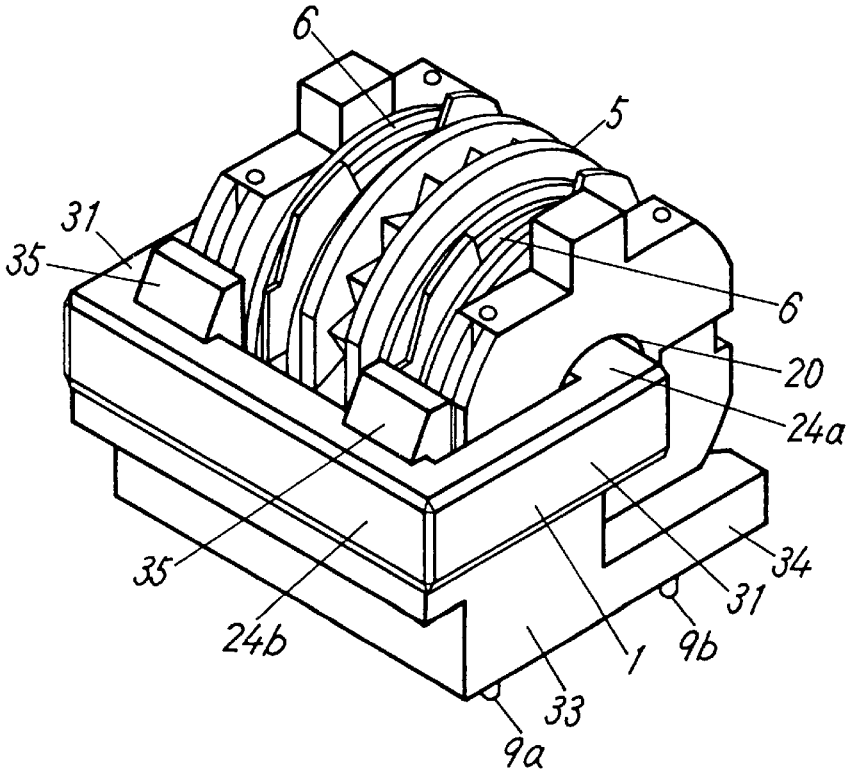
FIG. 23 is a perspective view of a line filter as a sixth exemplary embodiment of the present invention.
Figure 24:
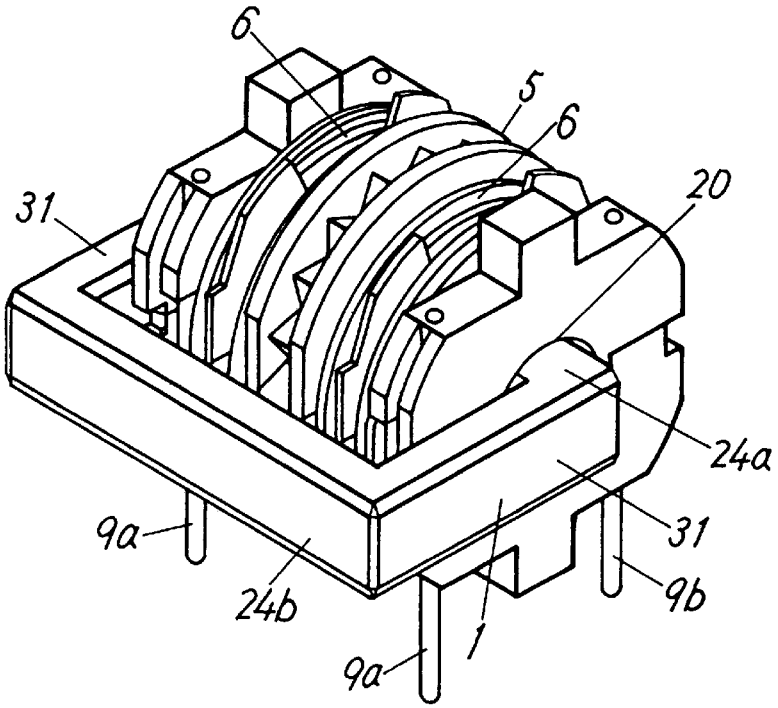
FIG. 24 is a perspective view of the foregoing line filter before installation of a wobbling preventive means and FIG. 25 is a perspective view of the wobbling preventive means for the foregoing line filter.
Figure 25:
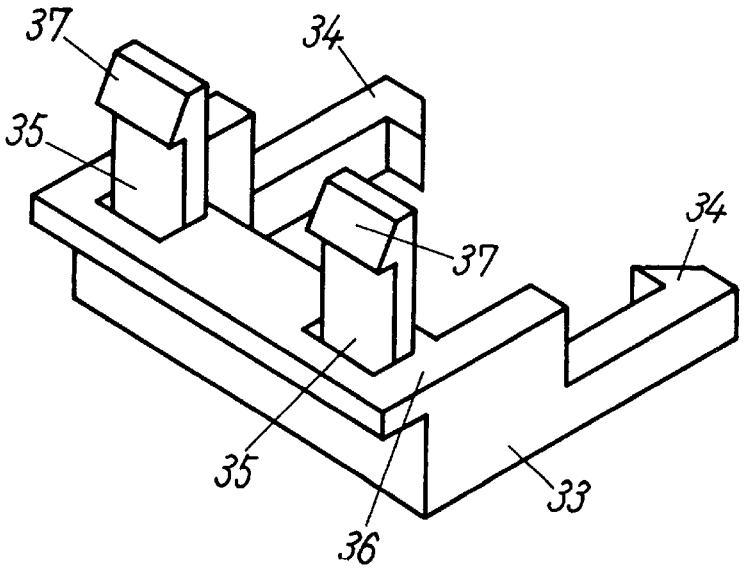

FIG. 23 is a perspective view of a line filter as a sixth exemplary embodiment of the present invention, FIG. 24 is an exploded perspective view of the foregoing line filter before installing a wobbling preventive means and FIG. 25 is a perspective view of the wobbling preventive means for the foregoing line filter.

In Example 6, a supporting seat 33 as illustrated in FIG. 25 is provided under a bobbin 5. More specifically, the supporting seat 33 comprises a pair of a first clamping arrangement 34, each extending horizontally with a specified distance separated from each other and another pair of a second clamping arrangement 35, each extending vertically with a specified distance separated from each other as shown in FIG. 25. As shown in FIG. 23, the first clamping arrangements 34 are engaged in the root of an output terminal 9*b* at the side of the bobbin 5 as shown in FIG. 24, and the second clamping arrangements 35 are inserted between the bobbin 5 and an opposing magnetic leg 24*b* of a closed magnetic circuit core 1 and engaged with the upper surface of the opposing magnetic leg 24*b*.

Accordingly, both side magnetic legs 31 and the opposing magnetic leg 24*b* of the closed magnetic circuit core 1 are sitting on the support surface 36 of the supporting seat 33 and the upper surface of the opposing magnetic leg 24*b* is held securely by claws 37 of the second clamping arrangements 35. As a result, the closed magnetic circuit core 1 is securely fixed on the support surface 36 of the supporting seat 33.

Under this condition, the bobbin 5 is brought into a state wherein it is supported by the supporting seat 33, and when the assembled line filter is mounted on a printed circuit board and the like, for example, a flat U shaped plane of the supporting seat 33 comes in contact with the surface of the printed circuit board, thus having the bobbin 5 securely mounted on the printed circuit board.

Moreover, even under this state, the lower ends of the input and output terminals 9*a* and 9*b* stick out of the bottom surface of the supporting seat 33 downwards and the sticking out ends go through feed-through holes of the printed circuit board. Although the first clamping arrangements 34 of the supporting seat 33 are engaged in the output terminals 9*b* in the present example, the first clamping arrangements 34 may also be engaged directly with the input terminals 9*a* or bobbin 5.

EXAMPLE 7

Next, an explanation will be made on a line filter as a seventh exemplary embodiment of the present invention with the help of drawings.

Figure 26:
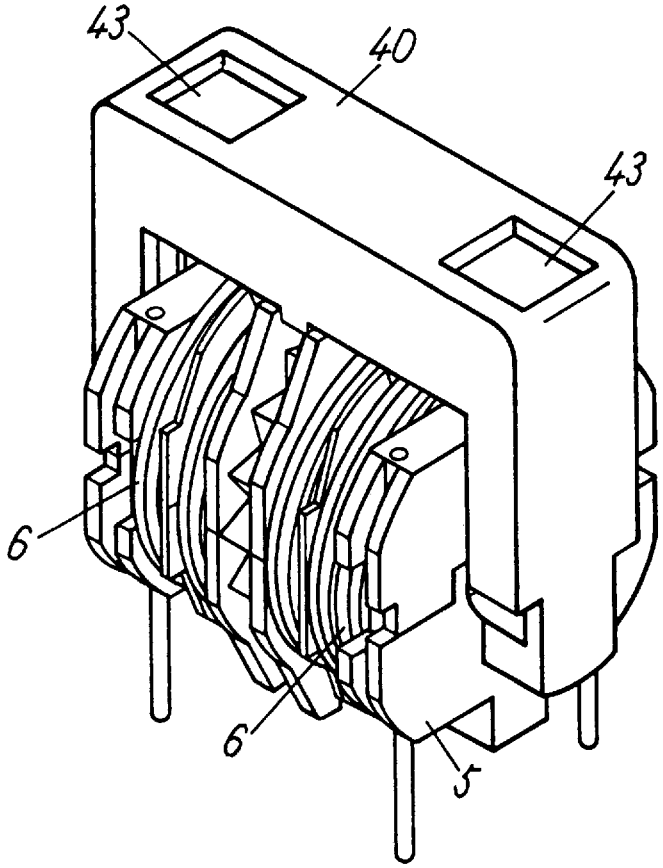
FIG. 26 is a perspective view of a line filter as a seventh exemplary embodiment of the present invention.
Figure 27:
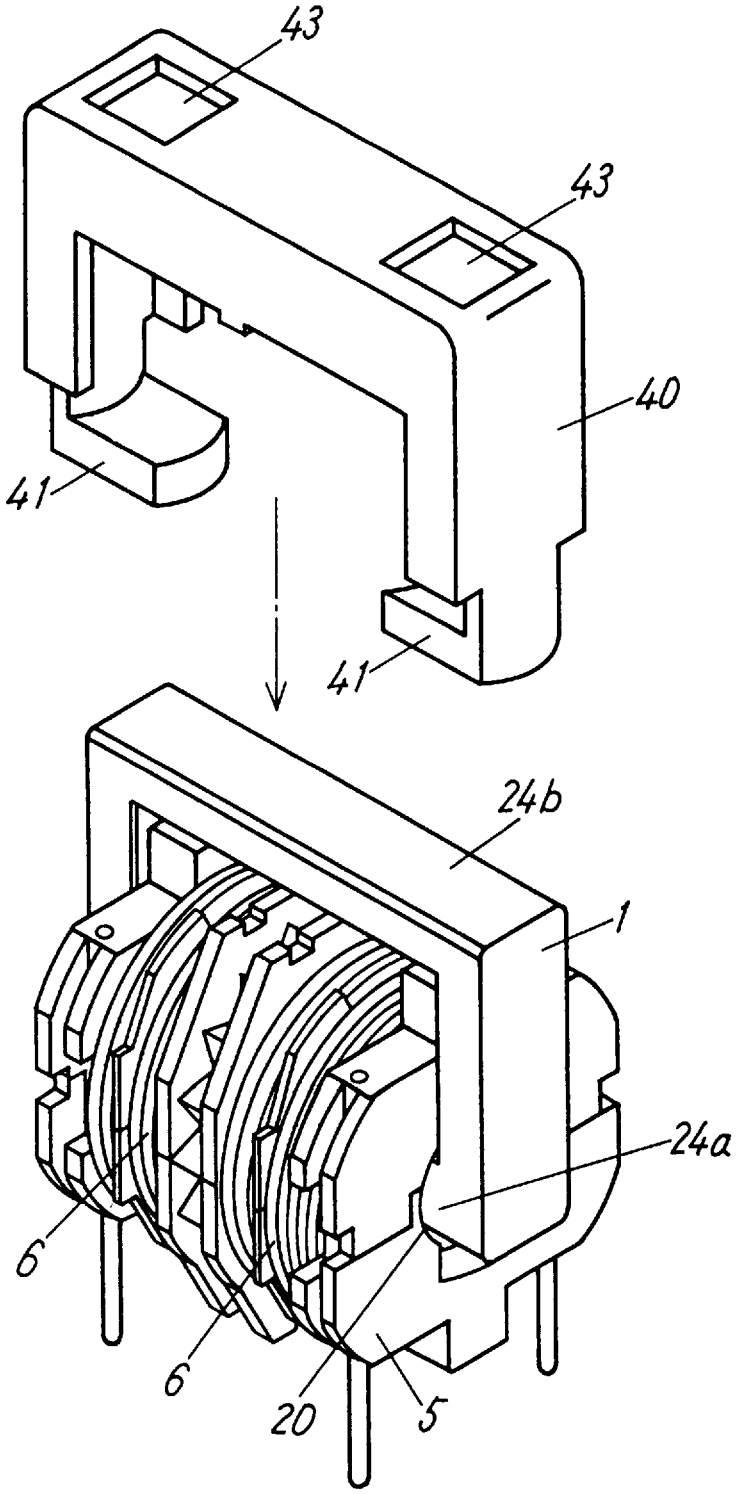
FIG. 27 is an exploded perspective view of the foregoing line filter and FIG. 28 is a perspective view of a bobbin for the foregoing line filter when the bobbin is split into two parts.
Figure 28:
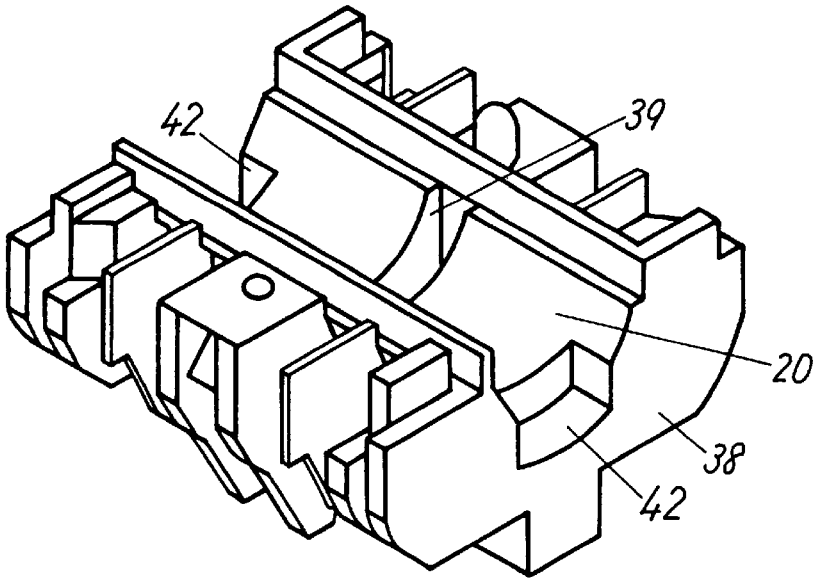
Figure 29:
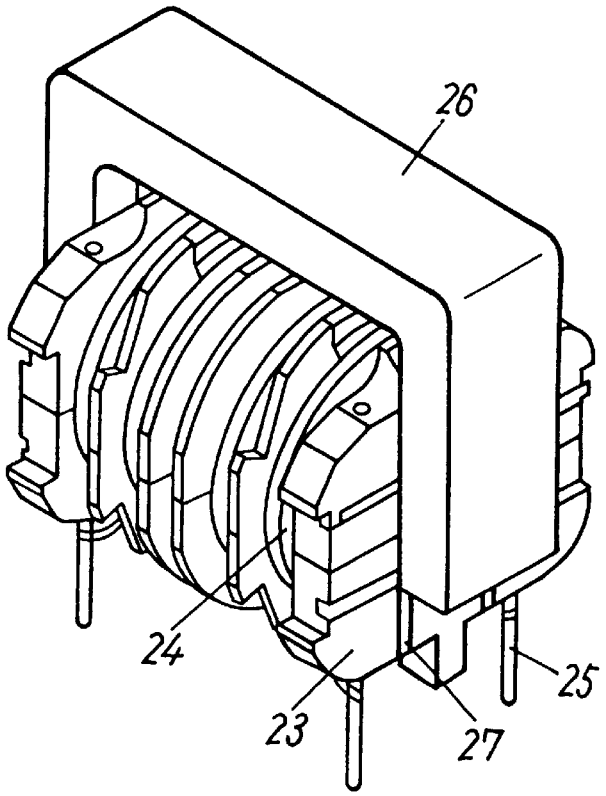
FIG. 29 is a perspective view of a prior art line filter.
Figure 30:
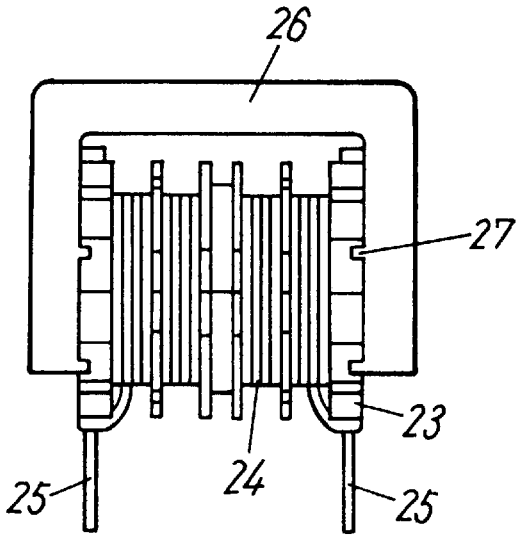
FIG. 30 is a front view of the foregoing line filter.
Figure 31:
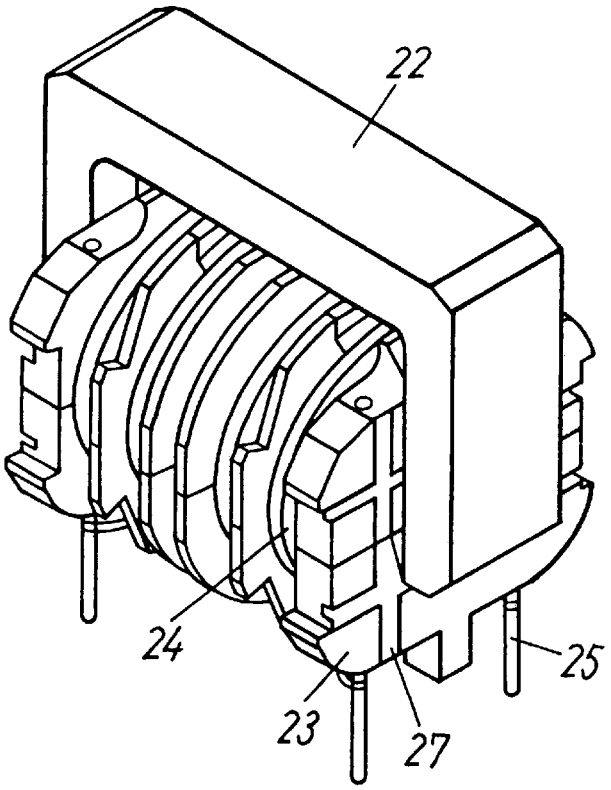
FIG. 31 is a perspective view of the line filter before installation of a wobbling preventive means.

FIG. 26 is a perspective view of a line filter as a seventh exemplary embodiment of the present invention, FIG. 27 is an exploded perspective view of the foregoing line filter and FIG. 28 is a perspective view of a bobbin split into two parts for use in the foregoing line filter.

In Example 7, a bobbin 5 is split into two parts at a position including its through hole 20, and one of the magnetic legs of a closed magnetic circuit core 1 is held between the two split pieces of the through hole 20. After the split pieces of the through hole 20 are put together, windings 6 are wound around the bobbin 5.

Here, an explanation will be made on splitting the bobbin 5 into two parts. As illustrated in FIG. 28, the bobbin 5 is composed of two of a half cylindrical body 38 by putting the two parts together after one of the two parts is rotated by half a turn with the sides of the through hole 20 being kept towards inside. A recessed section 39 is formed in the center of the through hole 20 of each respective half-cylindrical body 38 in order to prevent the half-cylindrical body 38 from swelling a little in the middle part. Otherwise, a proper cylindrical body is not constructed due to a swelling in configuration that is present in the middle part when the two half-cylindrical bodies 38 are put together.

Next, the foregoing closed magnetic circuit core 1 is set upright with the magnetic leg 24*b* opposing to one magnetic leg 24*a* that is positioned above the bobbin 5 and, while this state being maintained, a core cover 10 made of a synthetic resin is installed so as to cover the opposing magnetic leg 24*b*. The core cover 10 is shaped like a flat U letter and its both ends are bent towards inside. By having the bent portions 41 inserted in recesses 42 that are formed on both ends of the through hole 20 of the bobbin 5, the closed magnetic circuit core 1 is securely held and fixed, thus protecting the closed magnetic circuit core 1 and preventing its opposing magnetic leg 24*b* from wobbling.

Furthermore, openings 43 formed at both ends of the upper surface of the core cover 10 facing the opposing magnetic leg 24*b* are intended for dissipating heat from the closed magnetic circuit core 1. Also, providing the openings 43 in the core cover 10 facilitates the molding of the core cover 10 made of a synthetic resin by making the flow of the resin easier.

USABILITY IN THE INDUSTRY

As described in the above, the structures disclosed by the present invention are characterized by comprising a bobbin with a flange formed on each respective end and a through hole running along its axis, windings wound around the foregoing bobbin between both flanges in the direction perpendicular to the bobbin's axis and terminals embedded in the above flanges and connected with the foregoing windings, and by providing a wobbling preventive means to prevent the foregoing closed magnetic circuit core from wobbling.

Thus, due to the provision of the wobbling preventive means to prevent the closed magnetic circuit core from wobbling, a core cover and the closed magnetic circuit core are securely fixed with each other and the closed magnetic circuit core does not wobble around the periphery of the bobbin.

Therefore, it has become possible to provide a line filter that suppresses the magnetic adverse effects inflicted on other surrounding components due to leakage magnetic fluxes from the closed magnetic circuit core and also suppresses infiltration of noises into the closed magnetic circuit core.

We claim:

1. A line filter comprising:

a bobbin having flanges on its both ends and a through hole along its axis;

a closed magnetic circuit core with one of its magnetic legs inserted in the through hole of said bobbin;

a winding wound between both flanges of said bobbin in the direction perpendicular to the bobbin's axis;

terminals implanted in said flanges and connected with said winding; and a wobbling preventive means to prevent said closed magnetic core from wobbling, provided on a core cover to cover the periphery of the other magnetic leg opposite to the magnetic leg inserted in the through hole of the bobbin and side magnetic legs of said closed magnetic circuit core.

2. A line filter according to claim 1, wherein the bobbin is divided into two pieces along the through hole and each respective through hole portion of the cylindrical body that has been divided into two pieces is provided with a recessed section.

3. A line filter according to claim 1, wherein an opening is provided to the core cover.

4. A line filter according to claim 1, wherein both ends of the core cover are inserted in the through hole of the bobbin and fixed thereto to serve as the wobbling preventive means.

5. A line filter according to claim 4, wherein the bobbin is divided into two pieces along the through hole and both ends of the cylindrical through hole to be divided into two pieces are provided with recessed sections, in which both ends of the core cover are inserted, thereby serving as the wobbling preventive means.

6. A line filter according to claim 1, wherein the wobbling preventive means comprises a core fixing member to fix the closed magnetic circuit core and bobbin holding members opposing to the side surfaces of the flanges to hold the bobbin securely, both provided on the core cover, a fastening means is provided on said each respective bobbin holding member to engage said flanges of the bobbin with said bobbin holding members and also a holding means is provided on said each respective flange to hold said bobbin holding members, thus providing a means to engage said core cover in said flanges of the bobbin precisely in position.

7. A line filter according to claim 6, wherein a first rib is formed on the inside of said core fixing member of the core cover so that said first rib is pressed against the closed magnetic circuit core.

8. A line filter according to claim 7, wherein the first rib is projected like a conical shape.

9. A line filter according to claim 6, wherein a second rib is formed on the side surface of said each respective bobbin holding member facing the flanges so that said second rib is pressed against said flanges.

10. A line filter according to claim 9, the second rib is projected like a conical shape or a triangular pyramid.

11. A line filter according to claim 6, wherein a strengthening rib is formed between the outer side surface of said each respective bobbin holding member and that of the core fixing member.

12. A line filter according to claim 6, wherein a split flange is formed between the flanges of the bobbin to divide the winding, the height of said split flange is the same as the height of said flanges, a flat portion is formed on the upper surface of said split flange and an engagement portion is formed on said flat portion to engage with the lower part of the core cover's center.

13. A line filter according to claim 6, wherein a projection is formed on the bottom of the core cover's center portion, a gear is formed in the central section of the bobbin and said projection is engaged with said gear.

14. A line filter according to claim 6, wherein said fastening means is comprised of a projection protruded from said each respective bobbin holding member of the core cover towards the side surface of said each respective bobbin's flange and also said holding means is comprised of an recess or a hole to engage with said projection.

15. A line filter according to claim 6, wherein said holding means is comprised of a projection formed on said each flange and the closed magnetic circuit core is held securely with precise positioning in the horizontal direction by said projection and fastening means.

16. A line filter comprising:

a bobbin having flanges on its both ends and a through hole along its axis;

a closed magnetic circuit core with one of its magnetic legs inserted in the through hole of said bobbin;

a winding wound between both flanges of said bobbin in the direction perpendicular to the bobbin's axis;

terminals implanted in said flanges and connected with said winding; and a wobbling preventive means to prevent said closed magnetic core from wobbling, which has a fastening means to have said closed magnetic circuit core and said bobbin engaged with each other and also to cover the opposing magnetic leg of said closed magnetic circuit core, further employing a cementing means to put together said fastening means and said bobbin by an adhesive.

17. A line filter according to claim 16, wherein the bobbin is divided into two pieces along the through hole and each respective through hole portion of the cylindrical body that has been divided into two pieces is provided with a recessed section.

18. A line filter according to claim 16, wherein said fastening means comprises legs and the bobbin is provided with adhesion pads while having said legs placed on said adhesion pads.

19. A line filter according to claim 18, wherein the surfaces of the adhesion pads are slanted downward towards outside of the closed magnetic circuit core.

20. A line filter comprising:

a bobbin having flanges on its both ends and a through hole along its axis;

a closed magnetic circuit core with one of its magnetic legs inserted in the through hole of said bobbin;

a winding wound between both flanges of said bobbin in the direction perpendicular to the bobbin's axis;

terminals implanted in said flanges and connected with said winding;

a wobbling preventive means to prevent said closed magnetic core from wobbling; and a supporting seat, which supports said bobbin while keeping the position of said closed magnetic circuit core horizontally and comprises a fastening means to hold said closed magnetic circuit core firmly, for the purposes of supporting said bobbin and also holding said closed magnetic circuit core firmly, thereby serving as said wobbling preventive means.

21. A line filter according to claim 20, wherein said supporting seat is provided with a second clamping arrangement that is engaged with the opposing magnetic leg of said closed magnetic circuit core.

22. A line filter according to claim 20, wherein said bobbin is split into two including its through hole and a recessed section is formed in the through hole portion of the split cylindrical body.

23. A line filter according to claim 20, wherein said supporting seat is provided with clamping arrangements that are engaged with said bobbin or terminals at both ends of the bobbin.

24. A line filter according to claim 23, wherein said supporting seat is provided with a second clamping arrangement that is engaged with the opposing magnetic leg of said closed magnetic circuit core.

* * * * *